US009951787B2

(12) United States Patent
De Santis et al.

(10) Patent No.: US 9,951,787 B2
(45) Date of Patent: Apr. 24, 2018

(54) IMPELLER FOR A FLUID ENERGY MACHINE

(71) Applicant: IHI CHARGING SYSTEMS INTERNATIONAL GMBH, Heidelberg (DE)

(72) Inventors: Roberto De Santis, Sulzbach (DE); Daniel Just, Kronau (DE)

(73) Assignee: iHi CHARGING SYSTEMS INTERNATIONAL GMBH, Heidelberg (DE)

( * ) Notice: Subject to any disclaimer, the term of this patent is extended or adjusted under 35 U.S.C. 154(b) by 445 days.

(21) Appl. No.: 14/588,448

(22) Filed: Jan. 1, 2015

(65) Prior Publication Data

US 2015/0125302 A1 May 7, 2015

Related U.S. Application Data

(63) Continuation-in-part of application No. PCT/EP2013/002104, filed on Jul. 16, 2013.

(30) Foreign Application Priority Data

Jul. 26, 2012 (DE) ..... 10 2012 106 810

(51) Int. Cl.
*F04D 29/28* (2006.01)
*F01D 5/14* (2006.01)
*F04D 17/00* (2006.01)

(52) U.S. Cl.
CPC ..... *F04D 29/284* (2013.01); *F01D 5/141* (2013.01); *F01D 5/143* (2013.01); *F04D 17/00* (2013.01); *F05D 2250/90* (2013.01)

(58) Field of Classification Search
CPC ..... F04D 29/284; F04D 17/00; F01D 5/141; F01D 5/143; F05D 2250/90
See application file for complete search history.

(56) References Cited

U.S. PATENT DOCUMENTS 4,465,433 A * 8/1984 Bischoff ..... F01D 5/141 415/181
5,215,439 A * 6/1993 Jansen ..... F04D 29/284 415/914
5,902,546 A * 5/1999 Kawasetsu ..... B21K 1/36 148/437

(Continued)

FOREIGN PATENT DOCUMENTS

DE 10 2010 020 307 11/2011
EP 1 239 116 9/2002

*Primary Examiner* — Woody Lee, Jr.
*Assistant Examiner* — Adam W Brown
(74) *Attorney, Agent, or Firm* — Klaus J. Bach

(57) ABSTRACT

In an impeller for a fluid energy machine with a hub and a plurality of rotor blades which are mounted on the hub and around which a medium may flow through the fluid energy machine and which form a blade duct between two neighboring rotor blades with a blade duct length which extends in the axial direction of the impeller, wherein each rotor blade is connected to the hub via a first transition region with a first curvature and via a second transition region with a second curvature and with a straight conical blade duct bottom of the blade duct formed between the first transition region and the second transition region.

9 Claims, 3 Drawing Sheets

(56) References Cited

U.S. PATENT DOCUMENTS

| | | | | |
|---|---|---|---|---|
| 6,471,474 | B1 * | 10/2002 | Mielke | F01D 5/02 29/889.21 |
| 7,354,243 | B2 * | 4/2008 | Harvey | F01D 5/143 415/191 |
| 7,465,155 | B2 * | 12/2008 | Nguyen | F01D 5/143 415/191 |
| 7,690,890 | B2 * | 4/2010 | Aotsuka | F01D 5/143 415/191 |
| 2009/0074580 | A1 | 3/2009 | Wu et al. | |
| 2012/0269636 | A1 * | 10/2012 | Xu | F01D 5/141 416/185 |

* cited by examiner (State of the Art)

(State of the Art)

IMPELLER FOR A FLUID ENERGY MACHINE

This is a Continuation-In-Part application of pending international patent application PCT/EP2013/002104 filed 2013 Jul. 16 and claiming the priority of German patent application 10 2012 106 810.0 filed 2012 Jul. 26.

BACKGROUND OF THE INVENTION

The invention relates to an impeller for a fluid energy machine including a rotor with a hub provided with rotor blades having curved transition regions between the hub and the blades.

Presently, fluid energy machines are provided in the form of exhaust gas turbo-chargers including compressors and turbines which are used in connection with combustion engines for power enhancement. It is therefore desirable that these fluid energy machines have a service life which corresponds at least to that of the combustion engines. Contrary to combustion engines, these fluid energy machines however have extremely high operating speeds of up to, and even far over, 100,000 rpm. Due to the high centrifugal forces the tensile strength of the impellers of the fluid energy machine must meet stringent requirements.

DE 10 2010 020 307 A1 discloses an impeller wheel of a fluid energy machine in the form of a radial compressor. This impeller comprises rotor blades which are fixedly connected to a hub of the impeller via transition regions. Contrary to conventional compressor wheels whose transition regions have an identically formed curvature both in the longitudinal direction of the rotor blade and in the circumferential direction of the hub, the compressor wheel of this unexamined German application exhibits a changing curvature in the longitudinal direction of the rotor blade.

However, the manufacture of such an impeller with different radii of the transition region over the length of the rotor blades is relatively expensive.

It is the principal object of the present invention to provide an impeller for a fluid energy machine which exhibits a very long service life and simultaneously is relatively inexpensive to manufacture.

SUMMARY OF THE INVENTION

In an impeller for a fluid energy machine with a hub and a plurality of rotor blades which are mounted on the hub and around which a medium may flow through the fluid energy machine and which form a blade duct between two neighboring rotor blades with a blade duct length which extends in the axial direction of the impeller, wherein each rotor blade is connected to the hub via a first transition region with a first curvature and via a second transition region with a second curvature and with a straight conical blade duct bottom of the blade duct formed between the first transition region and the second transition region.

Such an impeller for a fluid energy machine comprises a hub and a plurality of rotor blades around which a medium flowing through the fluid energy machine may flow, and which are connected with the hub via a first transition region with a first curvature and a second transition region with a second curvature. Between two neighboring rotor blades a blade duct is formed with a blade duct length extending in the axial direction of the impeller.

With the bottom of the blade duct between the first transition region and the second transition region changing variable at least in portions, a specific adaptation of the impeller design to stress conditions is provided so that, depending on the application range of the impeller, an appropriate stress-reducing and thus life-increasing result is obtained.

A special and cost-saving effect of this invention is that it is not necessary to generate a varying curvature that is to form a curvature from several radii successively, but due to the design of the blade duct bottom, the curvature can be made with one radius which is easy to produce, and additionally form the blade duct bottom in accordance with the demands on the impeller. Thus, with all manufacturing methods, regardless whether cutting or non-cutting methods, cost savings combined with high strength and thus long service life of the impeller are achievable.

In particular, for impellers with so-called backward inclined rotor blades whose transition regions are heavily loaded in particular on the pressure side, the stresses which occur during operation are greatly reduced.

Since the blade duct bottom in the area of the transition region is adapted and formed in consideration of the loads and the resulting stresses the impeller has a very long service life because it is capable to withstand high stresses in the transition region over a long time. This demand-based adaptation of the blade duct bottom in the area of the transition region prevents the undesired premature failure of the impeller, e.g. by cracks formed in the transition region from the rotor blade to the base body due to overloading.

In an advantageous embodiment, the blade duct bottom is formed to be adapted to an essentially linearly extending surface, wherein the surface is inclined relative to a hub tangent plane and extends at an angle with respect to the hub tangent plane. Herein the section line between the hub surface and the hub tangent plane defines a total length of the surface which extends in the circumferential direction of the hub. In other words, the blade duct bottom is formed to be adaptable to an inclined and an essentially plane surface. The blade duct bottom does not necessarily and evidently show this plane surface, but is formed essentially adapted to the surface. In other words, there is a virtual surface is along which the blade duct bottom extends, without however exactly following its geometry. This means that e.g. the blade duct bottom may as well comprise a convex or concave superimposition of the essentially plane surface. Here, the extra advantage is given in that an additional strength of the first and/or second transition region is obtained if the blade duct bottom in the area of the transition regions is adequately designed. This increased strength results in a reduction of stresses in the impeller.

The special and thus cost-saving effect of this invention is that it is not necessary, as is generally the case, to form several successive radii for generating a curvature, but it is sufficient to provide the curvature with one radius which is easy to produce and to form an additional surface in the blade duct bottom Thus, with all manufacturing methods, regardless whether cutting or non-cutting methods, cost saving combined with high strength and thus long service life of the impeller are achievable.

It was found to be particularly advantageous that, when the impeller is a compressor wheel, the angle at a wheel exit, or when the impeller is in the form of a turbine wheel, the angle at a wheel entrance is within a range between 0.5 and 10. This means that the material structure has to be matched with the demand required for the impeller. Therefore, a large angle has to be provided in particular for highly stressed impellers, while with less stressed impellers, a smaller angle is well sufficient for stress reduction which ensures a long service life.

In another advantageous embodiment, the total length of the surface, when the impeller is a compressor wheel, or when the impeller is a turbine wheel, has, at least at a wheel exit area or at a wheel entrance area, respectively, a value within the range between 1 mm and half of the distance between two neighbouring rotor blades.

For a further weight reduction and thus material saving as well, it is provided that in the case of an impeller in the form of a compressor wheel or in the case of an impeller in the form of a turbine wheel, the total length of the hub surface starting from the wheel exit in the direction of the wheel entrance or starting from the wheel entrance in the direction of the wheel exit, respectively, is continuously decreasing. In particular, it has been found to be sufficient for a long service life that the total length starting from the wheel exit in the direction of the wheel entrance in the case of a compressor wheel or starting from the wheel entrance in the direction of the wheel exit in the case of a turbine wheel is zero for approx. 35% of the total length of the rotor blade. In other words, the surface is formed nearly triangular. By means of this embodiment, the highly stressed areas of an impeller can be strengthened effectively because the transition region extending over the total length of the rotor blade is not subjected to high stresses, but these stresses occur only partially in those areas of an impeller which are subject to high pressures and thus to high flow velocities as well as to high centrifugal forces. In the case of a compressor wheel, this is the highly stressed area of the wheel exit, while in the case of a turbine wheel, the particularly highly stressed area is in the wheel entrance area.

A further weight reduction with simultaneous stress reduction is obtained if the impeller has the form of a compressor wheel starting from the wheel exit in the direction of the wheel entrance, or if the impeller has the form of a turbine wheel starting from the wheel entrance in the direction of the wheel exit, the angle continuously decreases, whereby in particular starting from the wheel exit in the direction of the wheel entrance in the case of an impeller formed as a compressor wheel or starting from the wheel entrance in the direction of the wheel exit in the case of an impeller in the form of a turbine wheel, the angle at approx. 35% of the total length of the rotor blade has a value of 0.

The prevention of premature crack formation due to excessive stresses is very efficiently implemented with the inventive impeller because the transition region owing to the variable design change of the surface is formed demand-based and thus with a very efficient material consumption. With the inventive impeller, an undesired and unnecessary high material use for achieving the very long service life is avoided, so that the inventive impeller exhibits a very low weight at low costs. In other words, this means that where high stresses occur, a corresponding and, if required, higher material consumption is provided than in areas of the remaining transition region, where lower stresses during operation of the impeller prevail. There, a lower material consumption for achieving the very long service life of the impeller is possible.

If during operation of the impeller higher loads prevail in an area of the rotor blade than in another area of the rotor blade, with higher stresses resulting from the higher loads than from the lower loads, the transition region in the area with the stresses resulting from the higher loads has a surface area with a larger angle and a larger total length than in the areas with the low stresses.

The inventive impeller may therefore be manufactured cost effectively in accordance with the respective requirements imposed by the loads occurring in operation by means of a change in the design of the inclined surface. This also means that the impeller is made demand-based without an undesired and unnecessary high material use and high manufacturing costs while simultaneously exhibiting high strength over a long service life.

In a particularly preferred embodiment of the invention, the first transition region is formed differently from the second transition region. This means that in particular for impellers whose rotor blades are inclined towards the pressure side or towards the suction side, the transition regions may be differently formed according to the different stresses. When e.g. the rotor blades are inclined towards the pressure side, it is necessary for stress reduction to form in particular the transition region which is arranged on the suction side with one curvature and inclined surface adjoining the curvature. For the transition region on the suction side it is sufficient to provide exclusively one curvature for achieving a long service life. This embodiment means a very efficient and cost effective as well as demand-based design of the impeller which e.g. is a compressor wheel of a compressor of an exhaust gas turbocharger, at the simultaneous realization of a very long service life of the impeller.

When the impeller, as is provided in another embodiment is made essentially from aluminum, an aluminum alloy or the like, in addition to the long service life a reduction of the weight of the impeller and thus of the entire fluid energy machine is obtained. This weight reduction has a particularly advantageous influence on the fuel consumption of a combustion engine.

The invention will become more readily apparent from the following description of a preferred exemplary embodiment with reference to the accompanying drawings. The features and feature combinations as previously mentioned in the description as well as the features and feature combinations which will be mentioned in the following description of the figures and/or which are solely illustrated in the figures are not only applicable in the respective indicated combination but also in other combinations or isolated, without departing from the scope of the invention.

DESCRIPTION OF THE INVENTION IN COMPARISON WITH A PRIOR ART ARRANGEMENT

Figure 1:
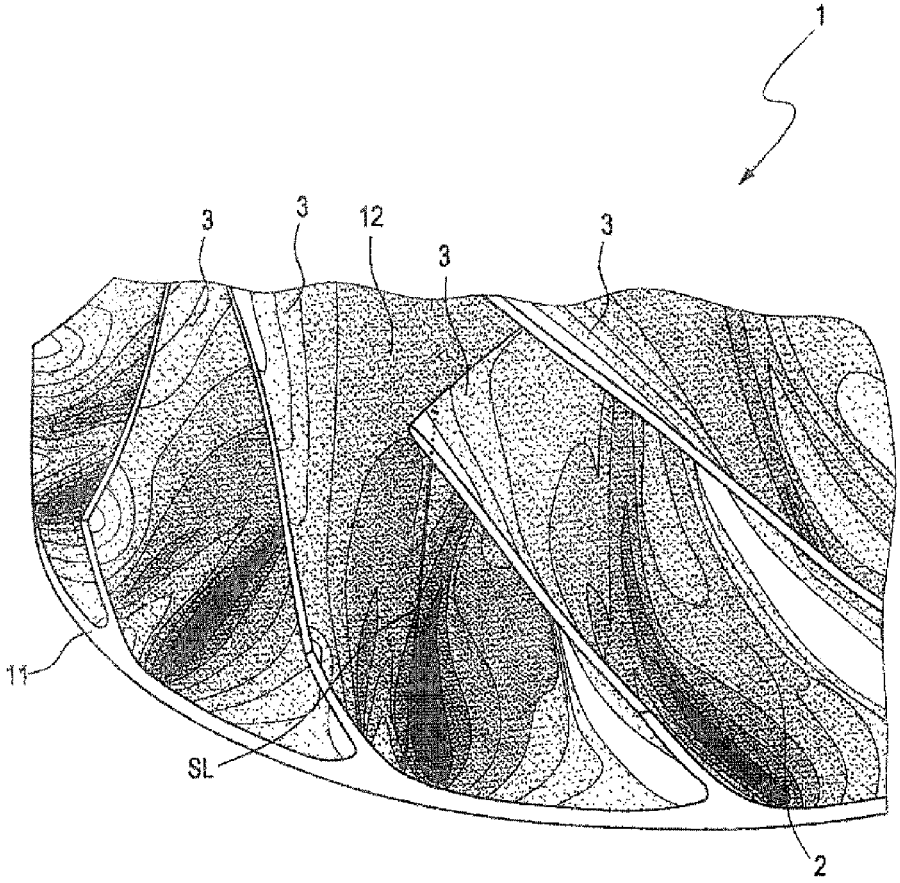
FIG. 1 shows a perspective view of a compressor wheel according to the state of the art indicating the stress distribution prevailing during operation.

FIG. 1 shows an impeller 1 in the form of a compressor wheel for a compressor (not shown in detail), in particular a radial compressor, of an exhaust gas turbocharger (not shown in detail) for a combustion engine (not shown in detail). The compressor is arranged on the fresh air intake side of the combustion engine, where essentially fresh air is compressed by the compressor wheel 1.

The compressor wheel 1 comprises a hub 2 as well as a plurality of rotor blades 3 which are fixedly connected with the hub 2. The hub 2 comprises a mounting opening (not shown in detail) by means of which the compressor wheel 1 is to be arranged on a shaft (not shown in detail) of the exhaust gas turbocharger and is non-rotatably connected to the shaft so that the compressor wheel 1 may be driven via the shaft by a turbine wheel (not shown in detail) of a turbine (not shown in detail) of the exhaust gas turbocharger to compress air. The rotor blades 3 and the hub 2 are formed integrally with each other. Between two neighboring rotor blades 3, a blade duct 12 is formed. The blade duct 12 has a blade duct length SL which extends in the axial direction of the impeller 1.

Figure 2:
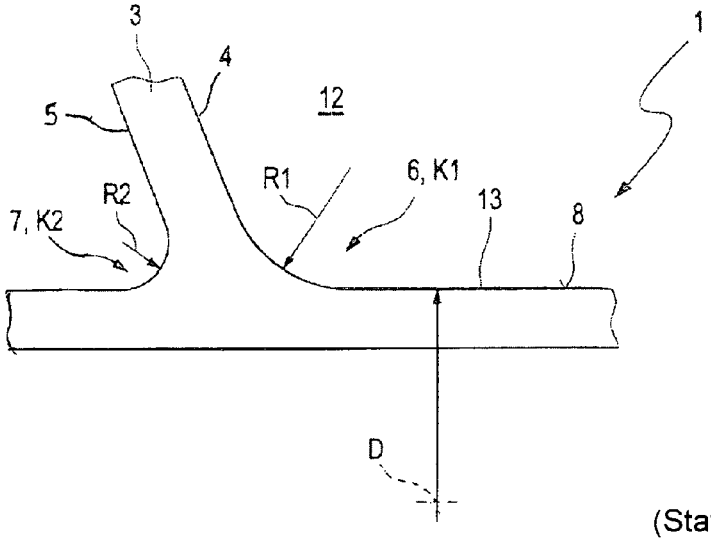
FIG. 2 is a schematic representation of a section of a development of a cross-section at the wheel exit of an impeller according to the state of the art.

FIG. 2 is a schematic view of a section of a development of a cross-section at the wheel exit 11 of the compressor wheel 1 according to the state of the art. The rotor blades 3 which are formed jointly with the hub 2 have both a suction side 4 and a pressure side 5 and are provided with a first transition region 6 on the pressure side as well as a second transition region 7 at the suction side 4. The first transition region 6 as well as the second transition region 7 are formed on a hub surface 8 of the hub 2 so that the joint areas extend both over a certain circumference of the hub 2 as well as over an axial extension of the hub 2. For the general description of the transition region 6, 7 it may be mentioned that the transition regions 6, 7 are characterized in that it forms a smooth connection between the rotor blade 3 and the hub 2. This means in other words, that, by means of the transition region 6, 7, discontinuities such as e.g. edge-like transitions in the connection area between hub 2 and rotor blade 3 are eliminated.

Extending over the circumference of the hub 2, the first transition region 6 has a first curvature K1 with a first radius of curvature R1 and the second transition region 7 has a second curvature K2 with a second radius of curvature R2, wherein the second radius of curvature R2 is smaller than the first radius of curvature R1. However, the first radius of curvature R1 could also be formed corresponding to the second radius of curvature R2, or the first radius of curvature R1 could be smaller than the radius of curvature R2. This is dependent on the inclination of the rotor blade 3 relative to the hub 2. The first curvature K1 as well as the second curvature K2 could also comprise not only one radius but several radii merging into each other, so that in a section transversely to an axis of rotation D the first curvature K1 or the second curvature K2, respectively, is formed curved following any curve function.

In their axial extension, the radius of curvature R1 and the radius of curvature R2 of the first transition region 6 or of the second transition region 7, respectively, are uniform or variable. In the state of the art, the first transition region 6 and the second transition region 7 have an essentially circular-segmented shape.

Figure 3:
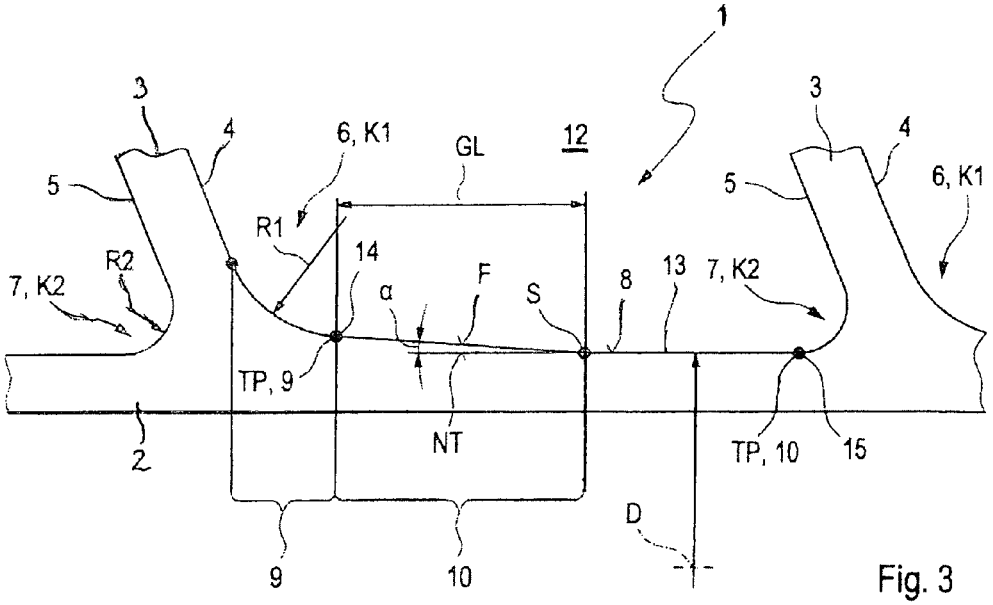
FIG. 3 shows a section of a schematic representation of a development of an inventive impeller at the impeller exit.

An inventive impeller 1 is herein configured e.g. in the form of a compressor wheel according to FIG. 3. Here, a first section 9 of the first transition region 6 of the rotor blade 3, which is arranged opposite the second transition region 7 of the neighboring rotor blade 3, is defined by an endpoint TP of the first curvature K1. This means that the first transition region 6 has a first curvature (R1) up to the end curve 14 along the blade duct 12 over the entire blade duct length SL.

Similarly, a second end 10 of the second transition region 7 of the rotor blade 3 is defined by the lowest point TP of the second curvature K2. This means that the second transition region 7 has a second end curve 15 along the blade duct 12 over the entire blade duct length SL, wherein the first end curve 14 and the second end curve 15 are positioned adjacent to each other, and the blade duct bottom 13 is formed between the first end curve 14 and the second end curve 15 extending both axially and in the circumferential direction of the hub 2.

Between the first transition region 6 and the second transition region 7 of the neighboring rotor blades 3 and thus between the first end curve 14 and the second end curve 15, the blade duct bottom 13 is formed variable in the circumferential direction as well as at least partially in the axial direction of the blade duct 12.

In this exemplary embodiment, the blade duct bottom 13 is variably formed so that the blade duct bottom 13 adapts smoothly to an essentially planar surface F starting from the first end curve 14. This surface F is inclined at an angle $\alpha$ relative to a hub tangent plane NT. In other words, the surface F is inclined in the representation of FIG. 3 clockwise towards the axis of rotation D starting from the first end 9 of the first transition region 6.

A section line S between the hub tangent plane NT and the surface F defines the total length GL of the surface F in the circumferential direction. This means that the angle $\alpha$ depends on the total length GL. The blade duct bottom 13 starting from the second end curve 15 could also be made to provide for a smooth transition to the surface F. This means that the surface F would then be inclined counterclockwise starting from the second transition region 7 towards the axis of rotation D. This means in other words that the actually formed blade duct bottom 13 need not be truly plane but may be defined by means of this surface F. Thus, the surface F could also be seen as a virtual surface F which, starting from the section line S may virtually extend along the blade duct bottom 13 at the angle $\alpha$ over the total length GL.

The total length GL of the surface F again is a function of the distance of two neighboring rotor blades 3. The distance of two neighboring rotor blades 3 corresponds to the blade duct width in the circumferential direction and is the distance which, when viewed clockwise, is formed between the first end curve 14 and the second end curve 15.

Figure 4:
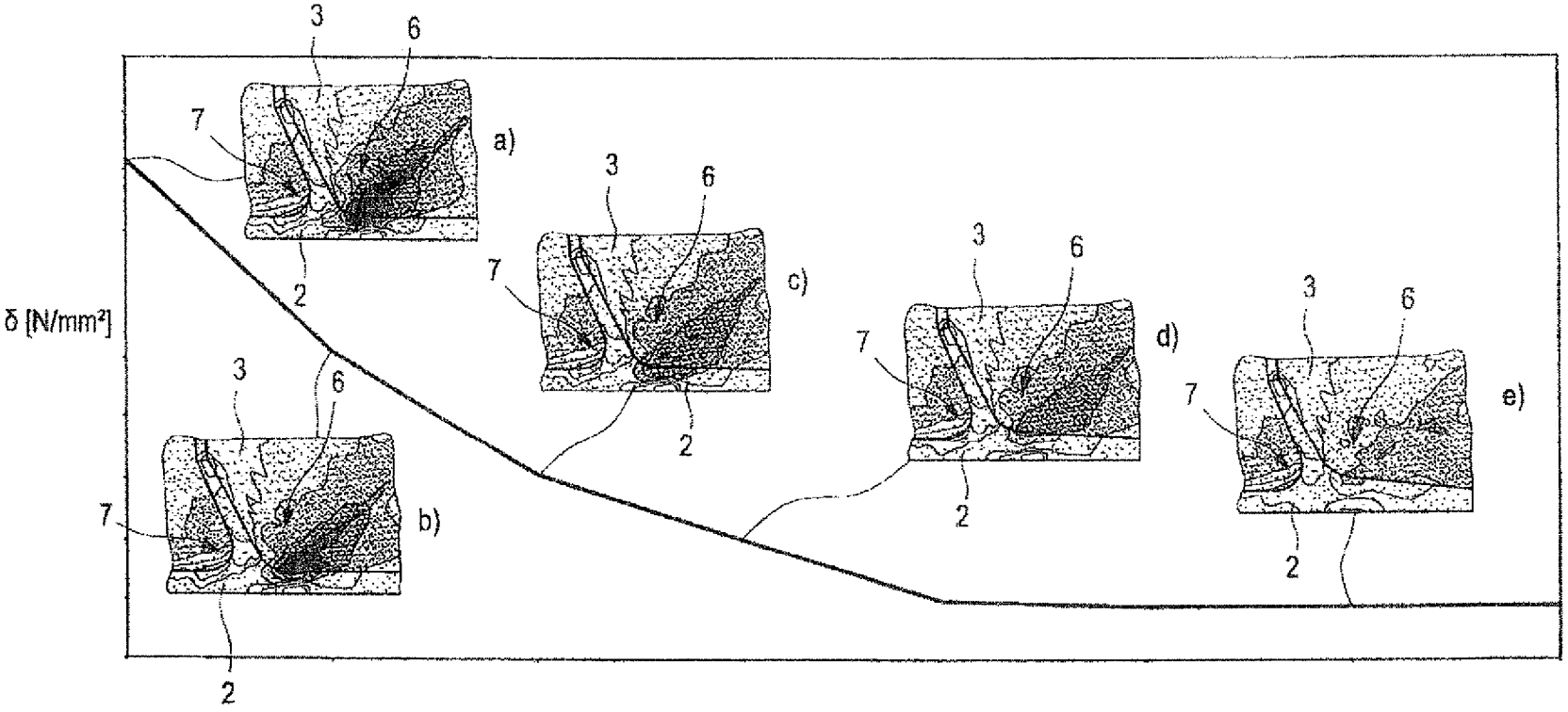
FIG. 4 shows a diagram of a stress curve upon the change of a transition region of the impeller with corresponding sections of an impeller in a perspective representation and the respective existing stress distribution.

FIG. 4 is a diagram which shows stress conditions in a compressor wheel, wherein the total length GL and the angle $\alpha$ are varied. Starting from the compressor wheel 1 shown in Fig. a), which has no variably formed blade duct bottom 13, a significant stress reduction can be achieved with an increasing total length GL and an increasing angle $\alpha$.

It was found to be particularly advantageous as shown in FIG. 4 *b*), that the total length GL should not be less than a minimum length of 1 mm and the angle $\alpha$ should not have a value smaller than 0.5 in order to achieve stress reduction. For the sake of clarity, the reference numerals in the figures are limited to the absolute minimum.

In the inventive impeller 1 in the form of a compressor wheel according to FIG. 4 *e*), a highest point or a highest curve of the blade duct bottom 13, respectively, does not necessarily correspond with the first end curve 14, relating to a distance between the axis of rotation D and the blade duct bottom 13. The reason for this is that depending on the embodiment of the impeller 1 as well as its load distribution or load cycle, respectively, and the max load or the resulting stress, respectively, an adequately adapted design of the blade duct bottom 13 is required.

The first transition region 6 extending in the axial direction of the hub 2 is formed essentially constant with the first curvature K1, wherein the surface F of the blade duct bottom 13 in respect to the total length GL as well as to the angle α starting from a wheel entrance (not shown in detail) towards the wheel exit 11 increases.

During operation of the compressor wheel 1, the intake air sucked in flows into the compressor wheel 1 via the wheel entrance (not shown in detail), then flows around the rotor blades 3 while being accelerated and, via the wheel exit 11 into an essentially diffusor-like duct (not shown in detail) where the air pressure increases.

In the flow direction of the air, i.e. starting from the wheel entrance towards the wheel exit 11, the loads and thus the stresses in the first transition region 6 and in the second transition region 7 increase, with the higher stresses occurring in particular in the first transition region 6 because it is formed in the pressure region. In order to achieve a particularly long service life of the compressor wheel 1, e.g. the first transition region 6, exhibits the constant radius of curvature R1 starting from the wheel entrance over an extension of approx. 65% of the total length of the rotor blades 3.

The surface F, starting from approx. 65% of the total length of the rotor blade 3 is formed continuously increasing from a value of the total length GL of 0 mm as well as from a value of the angle α of 0°, wherein the value of the total length GL increases to approx. half the distance between two neighboring rotor blades 3 and the value of the angle α increases to approx. 10° at the wheel exit 11. Thus, the first transition region 6 comprises a surface F which in combination with the radial extension of the first transition region 6 is formed as a ramp-like area at the wheel exit 11.

This keeps the stresses low. The stresses increase in the first transition region 6 from the wheel entrance towards the wheel exit 11, because the blade duct bottom 13 in the area of the first transition region 6 is adapted to the increasing loads and the resulting stresses.

With this design of the blade duct bottom 13, which is adaptable to the relevant demand an efficient material utilization for the embodiment of the compressor wheel 1 is achieved, so that a very low weight as well as very low costs together with a very long service life can be realized. In the compressor wheel 1, the blade duct bottom 13 is therefore formed different in areas where high loads and thus high stresses exist, from areas where lower loads or stresses, respectively, exist. Thus, prevention, in particular of crack formation in the transition region 6, which leads to a premature failure of the compressor wheel 1, is realized.

Herein, an impeller 1 is described by way of example whose blade duct bottom 13 is variably formed in the area of the first transition region 6 on the suction side 4 of the rotor blade 3. It is also possible that the blade duct bottom 13 in the area of the second transition region is variably formed in the area of the second transition region 7 on the pressure side 5 of the rotor blade 3. The blade duct bottom 13 in the area of the first transition region 6 or in the area of the second transition region 7, respectively, is to be adapted to the inclination of the rotor blade 3 relative to the hub 2. With an inclination of the rotor blade 3 in the direction of the suction side 4, for example, in particular the blade duct bottom 13 is to be variably and adequately formed in the area of the second transition region 5. Or more advantageously, the blade duct bottom 13 both in the area of the first transition region 4 and in the area of the second transition region 5 with an essentially non-inclined rotor blade 3 is to be variably formed.

It should be noted that the configuration of an impeller 1 has been described by way of example for an impeller in the form of a compressor wheel, although a turbine wheel may be configured correspondingly as well. However, the area of the wheel entrance of the turbine wheel has to be designed according to the area of the wheel exit of the compressor wheel in this case, because higher stresses occur in the turbine wheel at the wheel entrance.

Figure 5:
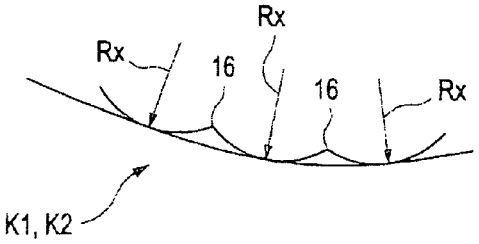
FIG. 5 is a schematic representation of a detailed view of a machined transition region of an impeller according to the state of the art.

The impeller 1 may be manufactured both by means of a milling method and by means of a casting method. If it is intended to produce a curvature K which differs from a circular section, i.e. to produce an ellipse section-like form of the curvature K, this is done according to the state of the art by a milling method through adjoining different radii Rx. As a consequence, at least when microscopically viewed, the surface of the curvature K is not smooth but exhibits peaks 16, as shown in FIG. 5. In particular for the application as a compressor impeller for an exhaust gas turbocharger of a combustion engine of a passenger vehicle, the inventive impeller 1 is particularly suited, because very high stress reductions and thus a significantly improved service life may be achieved without additional manufacturing cost expenditure.

The impeller 1 may be made in particular e.g. from the material Inconel 713C, Inconel 718, MAR246 or TiAl.

What is claimed is:

1. An impeller for a fluid energy machine, with a hub (2) having an axis of rotation (D) and a plurality of rotor blades (3) which are provided on the hub (2) and around which a medium flowing through the fluid energy machine may flow and wherein a blade duct (12) is formed between two neighboring rotor blades (3) with a blade duct length (SL) which extends in the axial direction of the impeller (1), each rotor blade (3) being connected with the hub (2) via a first transition region (6) with a first curvature (K1) and via a second transition region (7) with a second curvature (K2), the impeller having a blade duct bottom (13) of the blade duct (12) between the first transition region (6) and the second transition region (7) which is at least in sections formed with different rates of inclination with respect to the axis D of the hub (2) wherein, in an axial cross-sectional view, the blade duct bottom (13) is formed to extend axially along an essentially straight line defining a surface (F) which is inclined relative to an axial hub tangent plane (NT) at an angle (α), wherein an intersection point (S) between the surface (F) and the hub tangent plane (NT) defines a total length (GL) of the surface (F) which extends in the circumferential direction of the hub (2) with a diameter increasing from the intersection point S toward the end of the length (GL), that is the beginning of a transition section (9).

2. The impeller according to claim 1, wherein, with the impeller (1) configured in the form of a compressor wheel, the angle (α) at the wheel exit (11), or with the impeller (1) configured in the form of a turbine wheel, the angle (α) at the wheel entrance exhibits a value ranging between 0.5° and 10°.

3. The impeller according to claim 1 wherein, with the impeller (1) configured in the form of a compressor wheel, the total axial length (GL) of the surface (F) at least at the wheel exit (11), or, with the impeller (1) configured in the form of a turbine wheel, the total length (GL) of the surface (F) at least at the wheel entrance exhibits a value ranging between 1 mm and half of the distance between two neighboring rotor blades (3).

4. The impeller according to claim 1, wherein the total length (GL) of the surface (F) is formed continuously decreasing in the direction of the wheel entrance if the impeller (1) is configured in the form of a compressor wheel, or if the impeller (1) is configured in the form of a turbine wheel, is formed continuously decreasing in the direction of the wheel exit (11).

5. The impeller according to claim 4, wherein the total length (GL) has a value of 0 mm at approximately 35% of the total length of the rotor blade (3) if the impeller (1) is configured in the form of a compressor wheel starting from the wheel exit (11) in the direction of the wheel entrance or, if the impeller (1) is configured in the form of a turbine wheel starting from the wheel entrance in the direction of the wheel exit (11).

6. The impeller according to claim 1, wherein the angle ($\alpha$) is continuously decreasing if the impeller (1) is configured in the form of a compressor wheel starting from the wheel exit (11) in the direction of the wheel entrance or if the impeller (1) is configured in the form of a turbine wheel starting from the wheel entrance in the direction of the wheel exit (11).

7. The impeller according to claim 1, wherein the angle ($\alpha$) at approximately 35% of the total length of the rotor blade (3) has a value of 0° if the impeller (1) is configured in the form of a compressor wheel starting from the wheel exit (11) in the direction of the wheel entrance or if the impeller (1) is configured in the form of a turbine wheel starting from the wheel entrance in the direction of the wheel exit (11).

8. The impeller according to claim 1, wherein the first transition region (6) is formed different from the second transition region (7).

9. The impeller according to claim 1, wherein the impeller (1) is essentially made from an aluminum alloy.

* * * * *